US006598675B2

(12) United States Patent
Bussear et al.

(10) Patent No.: US 6,598,675 B2
(45) Date of Patent: Jul. 29, 2003

(54) DOWNHOLE WELL-CONTROL VALVE RESERVOIR MONITORING AND DRAWDOWN OPTIMIZATION SYSTEM

(75) Inventors: Terry R. Bussear, Friendswood, TX (US); Kevin R. Jones, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/865,085

(22) Filed: May 24, 2001

(65) Prior Publication Data

US 2002/0003038 A1 Jan. 10, 2002

Related U.S. Application Data

(60) Provisional application No. 60/207,756, filed on May 30, 2000.

(51) Int. Cl.[7] ..... E21B 35/14; E21B 43/12

(52) U.S. Cl. ..... 166/250.15; 166/66.7; 166/66; 367/83

(58) Field of Search ..... 166/250.15, 66.6, 166/66.7, 250.07, 250.17, 77.1, 77.2, 72, 87.1, 53, 66; 367/81, 83

(56) References Cited

U.S. PATENT DOCUMENTS

| | | | | | |
|---|---|---|---|---|---|
| 3,830,306 | A | * | 8/1974 | Brown | 166/334.2 |
| 4,625,798 | A | | 12/1986 | Bayh, III | 166/106 |
| 4,688,593 | A | | 8/1987 | Pringle et al. | 137/116 |
| 4,690,214 | A | * | 9/1987 | Wittrisch | 166/250.17 |
| 4,782,895 | A | | 11/1988 | Jacob et al. | 166/108 |
| 5,275,040 | A | * | 1/1994 | Codazzi | 166/254.1 |
| 5,355,952 | A | * | 10/1994 | Meynier | 166/117.5 |
| 6,082,454 | A | | 7/2000 | Tubel | 166/250.15 |
| 6,192,980 | B1 | * | 2/2001 | Tubel et al. | 166/53 |
| 6,234,247 | B1 | * | 5/2001 | Head | 166/106 |
| 6,268,911 | B1 | * | 7/2001 | Tubel et al. | 250/256 |
| 6,384,738 | B1 | * | 5/2002 | Carstensen et al. | 340/854.3 |
| 6,438,070 | B1 | * | 8/2002 | Birchak et al. | 367/83 |

FOREIGN PATENT DOCUMENTS

| | | |
|---|---|---|
| FR | 2 707 334 | 7/1993 |
| GB | 2 083 524 | 7/1981 |
| GB | 2 334 282 | 8/1999 |

* cited by examiner

*Primary Examiner*—David Bagnell
*Assistant Examiner*—Shane Bomar
(74) *Attorney, Agent, or Firm*—Cantor Colburn LLP

(57) ABSTRACT

A well control valve assembly having a downhole portion with a primary valve, and electromechanical actuator connected to the valve and a first wireless communicator connected to the actuator. The assembly further includes an uphole portion having a pump, a second wireless communicator complementary to the first wireless communicator and being supported in the uphole portion of the valve assembly. The downhole portion and uphole portion are physically non-connected and informationally connected.

10 Claims, 2 Drawing Sheets

DOWNHOLE WELL-CONTROL VALVE RESERVOIR MONITORING AND DRAWDOWN OPTIMIZATION SYSTEM

CROSS REFERENCE TO RELATED APPLICATIONS

This application claims the benefit of an earlier filing date from U.S. Provisional Application Ser. No. 60/207,756 filed May 30, 2000 which is fully incorporated herein by reference.

BACKGROUND

THE PRIOR ART

In certain wells that naturally produce very slowly, pumps are desirable. Pumps can increase the rate of production by pumping fluid faster than the well could otherwise push the fluid. Pumps, therefore, are desirable in many well situations. A drawback of the use of pumps however is that they generally have a limited life span (pumps generally have a life of about 80% shorter than other well components). Limited life span components necessitates frequent repair or replacement. In order to repair or replace a pump it must be withdrawn from the well. The activity requires that the well be opened. Thus, unless there is a means to close off the well or the well is killed dead, the removal of the pump causes spillage of well fluid into the surrounding environment. Clearly, this occurrence is environmentally unsound. To prevent said spillage, various attempts have been made to actuate a valve beneath the pump.

One prior art method employs a sleeve valve under the pump which is shiftable by a shifting sub. The sub includes an elongated section having a shifting profile thereon that engages a sleeve, through profile receptacles, shifts the same and then disengages therefrom in the downhole direction. The length of the shifting sub and all of the pipe joints thereabove must be exactly the same each time the upper section is pulled and run back in the hole or the sleeve will be damaged. Damage is caused by things being smashed into each other due to different lengths. Certainty about whether or not the sleeve is closed is also lacking.

Another prior art method for controlling flow when the pump is removed and, thus, the well is open is to employ a ball choke below the pump. The device operates on 50 to 200 psi and upon such pressure causes the valve to cycle in a "J" groove between on and off positions. The valve contains a ball receptacle which contains a "J" groove well known in the art, to cycle the valve to alternating on/off positions. The groove feature is actuated by pressurizing the well from the surface. Although the valve does function correctly in controlled conditions, the confidence in the positioning of the valve in the field is low. It is very difficult to definitively determine that the valve has been cycled only once when the pressure inducing apparatus is large. Because the valve is actuated between 50 and 200 psi and then bleeds pressure past the ball it is extremely easy to double cycle the valve which leaves it open again. Because of the lack of confidence in the position of the valve, delay is experienced. The well operator must wait a period of time after an attempted cycling to see if pressure climbs within the well or does not. This is the only assurance of the condition of the valve. If pressure does not rise, the valve is closed, if pressure does rise, the valve is open. Since, of course, in the oil production industry time is tremendously expensive, the method leaves much to be desired.

A system having a pump which can be separately removed from the well while leaving the valving structure intact and wherein such a system is reliable and in communication with other well functions.

SUMMARY

The above-discussed and other problems and deficiencies of the prior art are overcome or alleviated by the production well control system of the present disclosure.

The disclosure solves the problems inherent in the prior art and additionally provides optimization of well production.

In the disclosure, the pump is mechanically separated both from the valve structure and from valve operation such that the removal of the pump for repair or replacement may be accomplished without removal of or any deleterious effect on the valve system. Since, of course, communication is required between the pump and valve system and is desirable even beyond the valve system, a hydrophone or geophone is employed on each portion of the pump and valve system of the disclosure to provide communication across the mechanical gap between the pump assembly and the valve assembly. The first concept of the disclosure is sufficient to enhance the state of the art for pump repair and replacement. The disclosure however includes an additional and important feature.

In the additional feature of the disclosure, the valve assembly includes both primary and secondary valve structures, the primary valve being actuatable selectively, preferably by a downhole intelligence package, and the secondary valve structure being actuatable by removal or insertion of the primary valve structure. Because of the sensor(s) and controller involved with actuation of the primary valve, the system of the disclosure provides not only an on/off valve for pump issues but, further provides optimization of production of the well by enabling the valve to sense certain parameters regarding production and tailor the valve opening to produce the well as efficiently as the particular formation will allow. The information gained and decision made by the controller can also, of course, be transmitted to other locations by the hydrophone/geophone link or by wireline. The information is then also employed to modify pump rate to match the well production capability.

The above-discussed and other features and advantages of the present disclosure will be appreciated by and understood by those skilled in the art from the following detailed description and drawings.

DETAILED DESCRIPTION OF THE PREFERRED EMBODIMENT

The present disclosure provides for selective optimization and draw down of fluid flow through the borehole in which the system is installed while facilitating repair of more easily expended tools without disruption of other tools or uncontrolled flow from the well. The drawdown characteristic of the system is discussed first and its ability to optimize well production is discussed thereafter.

Figure 1:
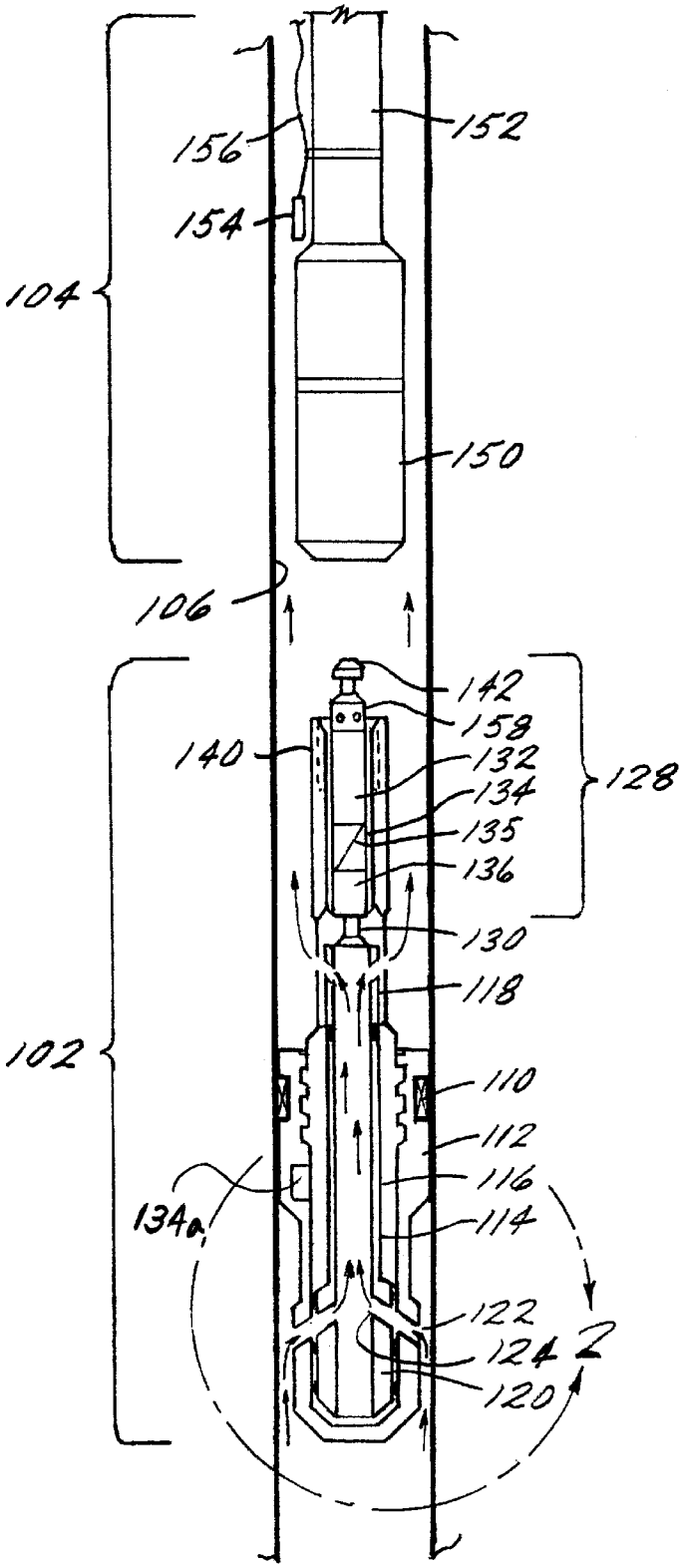
FIG. 1 is a schematic elevation view of the monitoring and drawdown optimization system.

Referring to FIG. 1, the system is schematically illustrated. The system comprises two major, mechanically independent components. A downhole portion 102 is supported by packer 110 set in a wellbore 106 whereas the uphole portion 104 is supported by tubing 152. The mechanically independent nature of the major parts of the system achieves the objective regarding the pulling of the pump with an effect wholly independent of the valve structure residing downhole thereof. In the system, virtually all of the components that have the longer service life are separated from the pump. When the pump is to be pulled from the well a signal need merely be sent to the valve structure to close the same and then the pump may be pulled. The valve may even automatically open and close based upon the acoustic signature of the pump. The valving components of the system need only be pulled when they themselves require repair or replacement.

Figure 2:
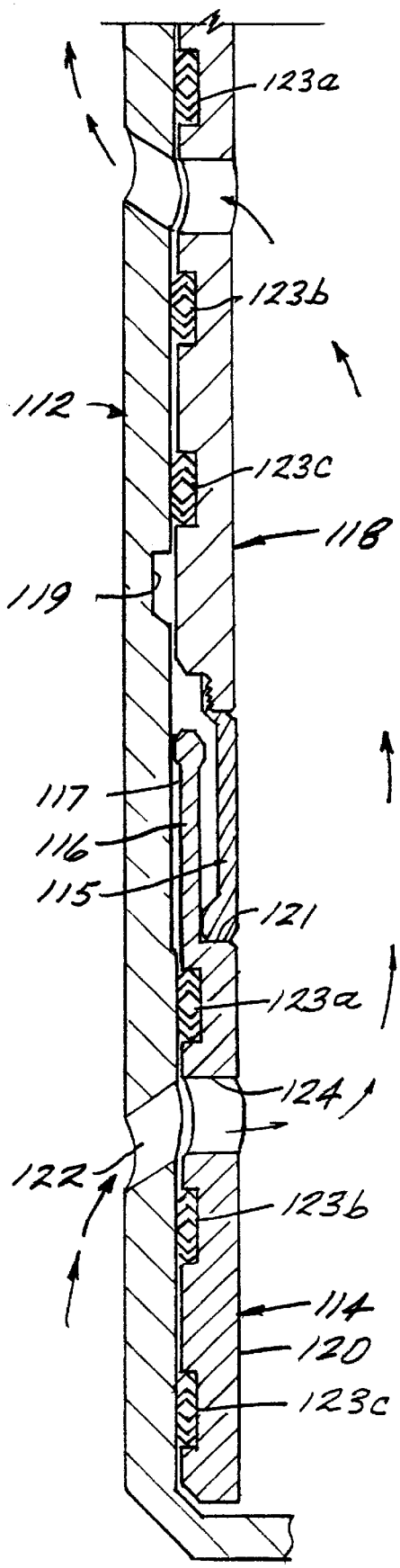
FIG. 2 is an enlarged view of the circumscribed area 2—2 in FIG. 1 and illustrates the actuation mechanism of the secondary valve of the system.

The downhole portion 102 of the system, which comprises the valve structure and electronics, is supported by the packer 110 which acts as a platform to locate portion 102. Portion 102 comprises housing 112 which supports secondary valve body 114 therein. Secondary valve body 114 is a mechanically actuated valve openable upon the engagement therewith of a primary sleeve valve 118 and closeable upon withdrawal of the primary valve from engagement therewith. Valve 118 engages body 114 at collet interface 116 (See FIG. 2). The mechanical action of engaging primary sleeve valve 118 through collet sub 115 and collet 116 to body 114 itself causes an inner sleeve 120 to move downhole and open a series of ports composed of sleeve ports 124 aligned with housing ports 122. When primary sleeve valve 118 lands on sleeve 120, the sleeve is urged down hole an amount sufficient to align ports 124 with ports 122. The purpose of secondary valve body 114 is to prevent flow past the housing 112 in the event the primary sleeve valve 118 is removed from the engaged position. Secondary valve body 114 is closed during removal of primary valve 118. Flow through secondary valve body 114 is allowed only while primary sleeve valve 118 is in its proper position. As one of skill in the art will appreciate then, the regulation of flow through portion 102 is primarily the responsibility of primary sleeve valve 118.

Referring again to FIG. 2, primary sleeve valve 118 is connected to sleeve 120, as stated, by collet 116. Collet 116 is of a type known to the art and provides several deflectable fingers 117. Initially, upon movement of primary sleeve valve 118 uphole, the collet (part of sleeve 120) is drawn uphole, closing ports 122. When the secondary valve body 114 is completely closed, fingers 117 move into recess profile 119 in housing 112. Recess profile 119 allows fingers 117 to deflect sufficiently to disengage from valve 118 that it may be removed. Thereafter recess profile 119 acts as a detent groove to hold secondary valve 114 closed. The reverse takes place upon installation of primary valve 118. Once valve 118 is engaged with fingers 117 it continues in the downhole direction until it abuts land 121 and forces body 114 downhole to align ports 122 and 124. Three seals 123 exist on each valve body and preferably are chevron seals. A housing port may be aligned with a valve body port when seals 123*a* and *b* straddle the port and is misaligned with the valve body port when seals 123*b* and *c* straddle the housing port. The seals prevent leakage around the respective valve bodies.

Primary valve 118 when installed in the well is controlled electromechanically by an electronics/control package 128 which is connected at interface 130 mechanically and electrically to primary valve 118. The electronics/control package 128 preferably contains a power source (e.g. battery pack, generator, capacitor, etc.) 132; a sensor 134 which may be a temperature, pressure, flow rate, water/oil ratio, vibration, particle motion or other parameter or a combination sensor; (more than one sensor could be employed in and around the valve assembly for example at least two sensors disposed above and below said primary valve with the below valve sensor schematically shown at 134*a*); a PC board 135; and an electro-mechanical valve actuator 136.

Any type of electromechanical actuator is contemplated including a motor and gear set, a solenoid, magnetic actuation, etc. Finally an electronics package receptacle 140 is attached to primary sleeve valve 118. This receptacle assists in positioning control package 128. It should also be noted that package 128 includes hydrophone 158 which is required for functionality of this embodiment, and nipple 142. The nipple is engageable by a conventional retrieval tool. Thus, in the event that downhole portion 102 must be pulled from the hole this can be easily accomplished with existing hardware. Control package 128 also provides in-well adjustability for the valve including adjustments of opening closing pressures in the well in real time.

The upper portion 104 of the system includes electric submersible pump 150 mounted to string 152 and a hydrophone (or geophone) 154 fed by a hard wire 156 to the surface or to another downhole location as desired. Since hydrophone 154 is preferably wired to the surface, information can clearly be transmitted thereto and received therefrom. Hydrophone 154 is capable of communicating acoustically with hydrophone 158 thereby maintaining communication in the form of transmission and reception of information between the surface or other downhole controllers and downhole portion 102 of the system. The hydrophones provide all necessary communication for the embodiment and enable the no-mechanical-connection system to be operable. The information transmittable between the hydrophones enables control of the condition (degree of openness) of valve 118 from a surface or downhole control location. For safety reasons a pressure sensitive closure of the valve 118 is preferred. More specifically, the valve closes automatically when down hole and requires a signal to open. This ensures that the valve 118 will stay closed when initially run until it receives a signal to open. It also is a fail-safe feature since without the open signal from hydrophone 154, primary sleeve valve 118 will shut-in the borehole.

Beyond the benefit the system has in overcoming the deficiencies of the prior art the consideration of which led to its conception, the system provides another benefit never even attempted before. As one of skill in the art will recognize a very simple controller can do the job of package 128 to discharge the duties of the system with respect to its intended purpose of allowing withdrawal of the pump for replacement or repair while maintaining control of the well. The present inventor recognized another benefit of a system such as this however if more intelligence could be imparted to package 128. Thus the sensors and electronics as discussed were developed to allow the system to monitor the head of fluid above the pump, whether the head grows or declines and other factors. By so measuring the primary valve 118 is settable through command by the controller 128 or by surface control (command received through hydrophones 158 and 154) to throttle the expressed formation fluids to maintain a steady and appropriate head above the pump. This condition optimizes production from the formation by effectively producing as much hydrocarbonaceous fluid as the well will bear. By maintaining the head and monitoring any movement the pump can be protected from premature failure due to running dry. Since the sensing devices and communications capabilities are in the immediate vicinity of the pump, the pump can be shut down before any harm results due to insufficient oil available to the pump. It is a significant benefit to the industry to provide an optimization system which is also a drawdown system. The environment is spared oil spillage and well operators are spared cost. Another aspect of this embodiment is that pump 150 is preferably mounted with its motor more downhole than its intake opening(s). The purpose of this is to enhance cooling of the motor from the movement of wellbore fluids over the motor. Such cooling action on the motor may prolong the service life thereof.

In an alternate embodiment, the open command may be the acoustic signature of the motor itself. Thus, an open signal need not be sent from the surface or other downhole command location and yet the well operator will be assured that the primary valve is open when the pump is on and closed when the pump is off. A benefit of the arrangement is that it avoids premature pump failure due to pumping when the valve is closed.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A well control valve assembly comprising:

a downhole portion having:

a primary valve;

an electromechanical actuator connected to said valve;

a first wireless communicator connected to said actuator;

an uphole portion having:

a pump supported by a support;

a second wireless communicator complementary to said first wireless communicator, said second wireless communicator being supported by said support wherein said downhole portion and said uphole portion are physically non-connected and are informationally connected by said first and second communicators.

2. A well control valve assembly as claimed in claim 1 wherein said downhole portion further includes a housing having a secondary valve actuatable by installation and removal of said primary valve, said secondary valve being opened by installation of said primary valve and closed by removal of said primary valve.

3. A well control valve assembly as claimed in claim 2 wherein said secondary valve is a sliding sleeve valve.

4. A well control valve assembly as claimed in claim 1 wherein said electromechanical actuator comprises:

a driver operably connected to said primary valve to open and close the same;

an electronics package connected to said driver and to said first wireless communicator; and a power source operably connected to said package.

5. A well control valve assembly as claimed in claim 4 wherein said actuator further includes at least one sensor, said at least one sensor sensing a parameter related to a well in which the sensor is positioned.

6. A well control valve assembly as claimed in claim 5 wherein said parameter is selected from the group consisting of temperature, pressure, flow rate, water/oil ratio, vibration, particle motion and temperature/pressure.

7. A well control valve assembly as claimed in claim 5 wherein said at least one sensor is at least two sensors disposed above and below said primary valve.

8. A well control valve assembly as claimed in claim 1 wherein first and second wireless communicators are hydrophones and communicate by acoustic signals.

9. A well control valve assembly as claimed in claim 8 wherein said acoustic signals are generated uphole and transmitted to the second communicator by a wire.

10. A well control valve assembly as claimed in claim 8 wherein said acoustic signals are generated inherently by the pump when running and are received by the first communicator.

* * * * *